US008434853B1

(12) United States Patent
Justice et al.

(10) Patent No.: US 8,434,853 B1
(45) Date of Patent: May 7, 2013

(54) PRINTHEAD CAP ASSEMBLY

(75) Inventors: Greg K Justice, Vancouver, WA (US); Rio Rivas, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/280,579

(22) Filed: Oct. 25, 2011

(51) Int. Cl.
*B41J 2/165* (2006.01)

(52) U.S. Cl.
USPC ..... 347/29

(58) Field of Classification Search ..... 347/29
See application file for complete search history.

(56) References Cited

U.S. PATENT DOCUMENTS

| | | | | |
|---|---|---|---|---|
| 4,045,802 | A * | 8/1977 | Fukazawa et al. | 347/29 |
| 5,867,184 | A * | 2/1999 | Quintana | 347/29 |
| 6,520,619 | B1 * | 2/2003 | Murcia et al. | 347/32 |
| 6,648,457 | B2 | 11/2003 | Smith et al. | |
| 6,648,458 | B2 | 11/2003 | Dod et al. | |
| 6,672,707 | B2 | 1/2004 | Silverbrook | |
| 6,948,801 | B2 | 9/2005 | Rehman et al. | |
| 7,101,018 | B2 * | 9/2006 | Yun | 347/29 |
| 7,195,334 | B2 * | 3/2007 | Nakamura | 347/29 |
| 7,661,803 | B2 | 2/2010 | Morgan et al. | |
| 7,748,820 | B2 * | 7/2010 | Shindo | 347/29 |
| 7,806,506 | B2 * | 10/2010 | Umeda | 347/29 |
| 2002/0008728 | A1 * | 1/2002 | Usui et al. | 347/29 |
| 2002/0158939 | A1 * | 10/2002 | Shima | 347/29 |
| 2003/0231222 | A1 * | 12/2003 | Jefferson et al. | 347/29 |
| 2004/0104961 | A1 * | 6/2004 | Hashi et al. | 347/29 |
| 2004/0189738 | A1 * | 9/2004 | Nakashima | 347/29 |
| 2004/0246295 | A1 * | 12/2004 | Aldrich et al. | 347/29 |
| 2006/0017790 | A1 | 1/2006 | Jin | |
| 2006/0221120 | A1 * | 10/2006 | Suzuki et al. | 347/29 |
| 2009/0322807 | A1 * | 12/2009 | Frazier et al. | 347/7 |
| 2010/0128083 | A1 | 5/2010 | Kuroki | |

* cited by examiner

*Primary Examiner* — Matthew Luu
*Assistant Examiner* — Alexander D Shenderov
(74) *Attorney, Agent, or Firm* — Erik Anderson

(57) ABSTRACT

Example embodiments disclosed herein relate to a printhead cap assembly. An example includes a rigid base member and a mount gimbaled with respect to the rigid base member and configured to define a recess including a side. The printhead cap assembly additionally includes a sealing member configured to include a retention feature positioned in the recess and engaging the side to orient and couple the sealing member to the mount so that the sealing member retains an original shape.

22 Claims, 5 Drawing Sheets

PRINTHEAD CAP ASSEMBLY

BACKGROUND

A challenge exists to deliver quality and value to consumers, for example, by providing imaging devices such as inkjet printers that are cost effective. Additionally, businesses may desire to enhance the reliability of such imaging devices. Further, businesses may desire to improve the performance of one or more components of such imaging devices.

BRIEF DESCRIPTION OF THE DRAWINGS

The following detailed description references the drawings, wherein.

DETAILED DESCRIPTION

Inkjet printing devices utilize a service station to help maintain the performance of inkjet printheads. One of the components of such service stations is a cap assembly that protects the printheads during periods of non-use. The cap assembly helps prevent debris from accumulating on the printheads, thereby keeping them clean. The cap assembly also seals the printheads to help prevent the nozzles of the printheads from drying out which can clog them.

One of the components of such printhead cap assemblies is the sealing member which directly contacts the printheads. This sealing member is attached to a mount of the cap assembly. The means used to attach the sealing member to the mount should not distort it, otherwise the cap assembly may not adequately protect the printheads due to one or more gaps caused by such distortion.

Figure 1:
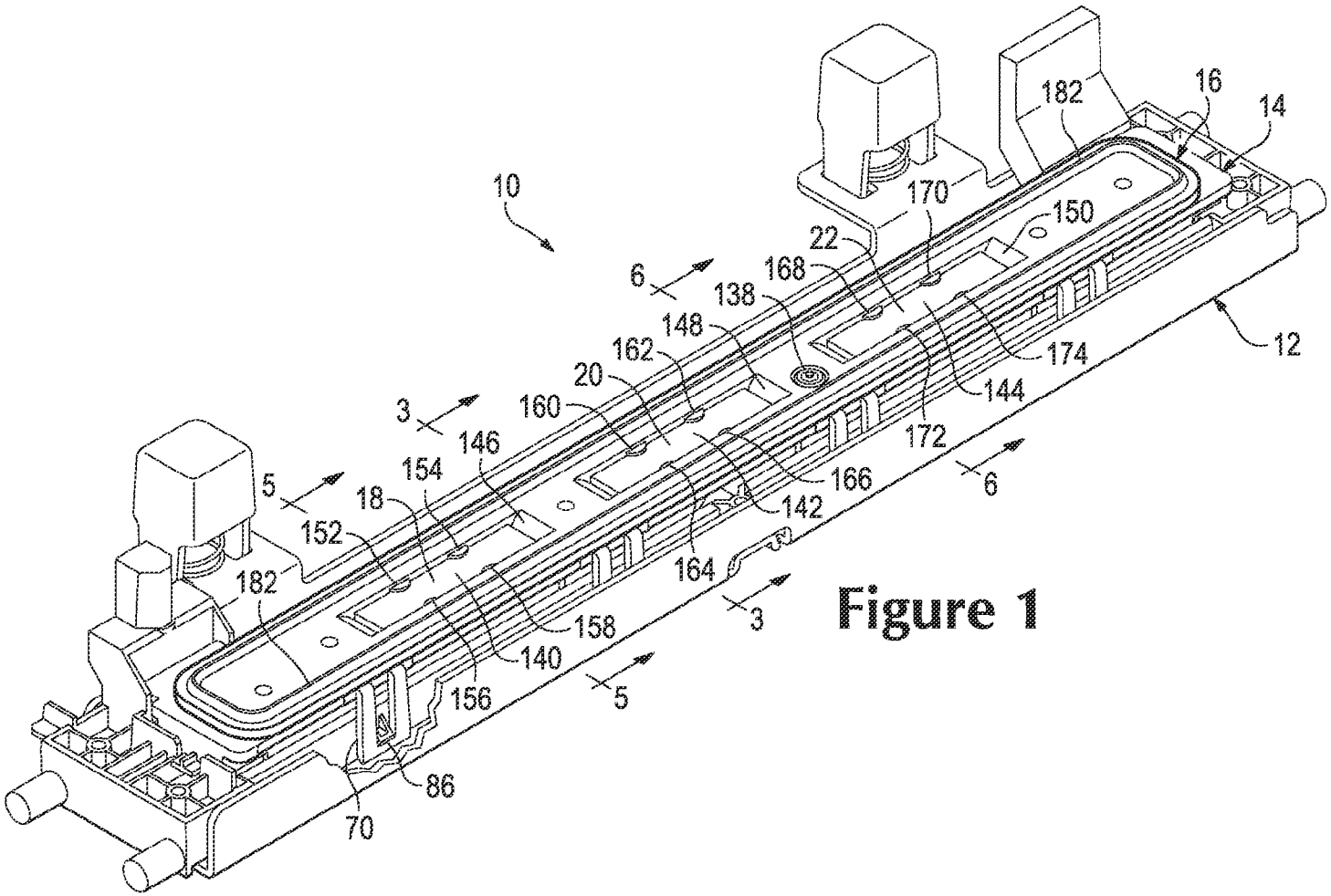
FIG. 1 shows a perspective view of an example of a printhead cap assembly.

A perspective view of an example of a printhead cap assembly 10 is shown in FIG. 1. As can be seen in FIG. 1, printhead cap assembly 10 includes a rigid base member 12, a mount 14, and a sealing member 16, each of which is discussed in more detail below. The example of printhead cap assembly 10 shown in FIG. 1 is designed for a page-wide array of three printheads each with drop ejectors and nozzles (not shown), one of each of which is enclosed and capped by lip 182 of sealing member 16 at respective general locations 18, 20, and 22. Other embodiments of printhead cap assemblies in accordance with the present invention may be designed for more or less printheads (including a single printhead), linearly arranged, as illustrated, staggered, or side by side.

Figure 2:
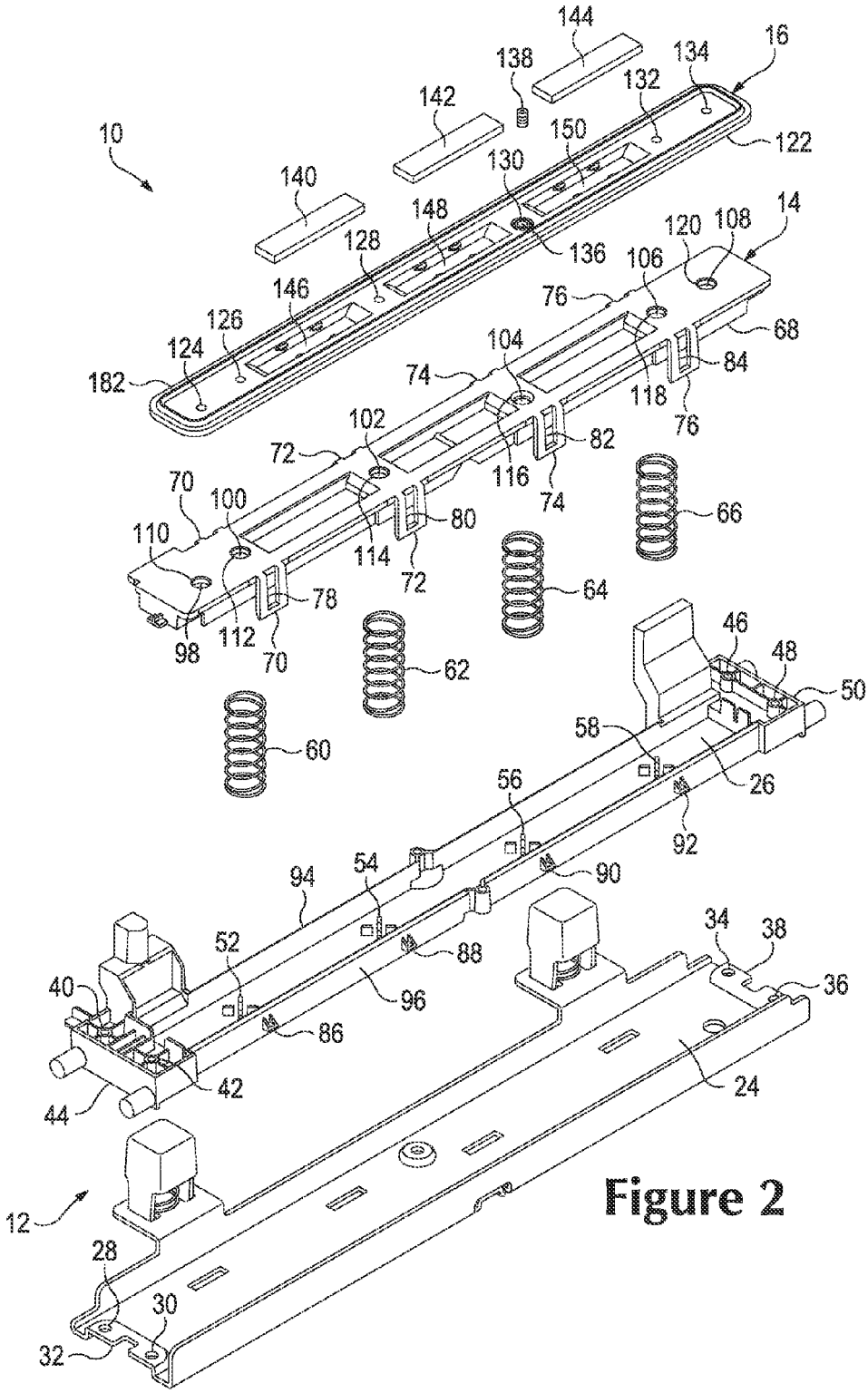
FIG. 2 shows an exploded perspective view of an example of a printhead cap assembly.

An exploded perspective view of an example of printhead cap assembly 10 is shown in FIG. 2. As can be seen in FIG. 2, rigid base member 12 includes a stiffener 24 made from metal or plastic and a plate 26 disposed on stiffener 24 which may also be made from metal or plastic. The combination of stiffener 24 and plate 26 of base member 12 are designed to attach cap assembly 10 to a service station (not shown in FIG. 2) of a printing device (also not shown in FIG. 2) and also to provide support to the other components of cap assembly 10. Stiffener 24 includes openings 28 and 30 on end 32 and openings 34 and 36 on end 38 through which fasteners (not shown) may be disposed into attachment features 40 and 42 on end 44 of plate 26 and attachment features 46 and 48 on end 50 of plate 26 to couple stiffener 24 to plate 26.

Bosses 52, 54, 56, and 58 are formed on or attached to plate 26 on which respective biasing members 60, 62, 64, and 66 are positioned. Although not shown in FIG. 2, similar bosses are formed on or attached to bottom side 68 of mount 14. Mount 14 attaches to plate 26 via, pairs of side members 70, 72, 74, and 76 each of which is formed to define a respective opening 78, 80, 82, and 84 through which pairs of side tabs 86, 88, 90, and 92 of plate 26 are respectively disposed. Although not shown in FIG. 2, it is to be understood that side 94 of plate 26 includes a set of side tabs 86, 88, 90, and 92 that correspond to side tabs 86, 88, 90, and 92 on side 96.

The above-described manner of attaching mount 14 to plate 26 allows side tabs 86, 88, 90, and 92 to slide within openings 78, 80, 82, and 84 as biasing members 60, 62, 64, and 66 are compressed and relaxed. It also creates a gimbal assembly that permits mount 14 of cap assembly 10 to deflect and move freely upon engagement with one or more printheads that may not be perfectly aligned in all three axes while still maintaining an adequate seal around them. It additionally helps prevent damage to these printheads potentially caused by contact with cap assembly 10.

As can also be seen in FIG. 2, mount 14 is configured to include or define openings, recesses or cavities 98, 100, 102, 104, 106, and 108 each of which includes a respective wall, side, or edge 110, 112, 114, 116, 118, and 120. As discussed more fully below, sealing member 16 is configured to include retention features or mounting flanges located on bottom 122 in the generally indicated positions 124, 126, 128, 130, 132, and 134. These retention features or mounting flanges are disposed or otherwise positioned in openings 98, 100, 102, 104, 106, and 108 to orient or align and couple or attach sealing member 16 to mount 14.

As can be additionally seen in FIG. 2, an ambient vent 136 is formed in sealing member 16 and is configured to communicate with the ambient environment. A vent plug 138 is disposed or positioned in ambient vent 136. Pads 140, 142, and 144 are respectively disposed or positioned in respective wells 146, 148, and 150 and secured therein by tabs 152, 154, 156, 158, 160, 162, 164, 166, 168, 170, 172, and 174, as shown in FIG. 1. Pads 140, 142, and 144 are designed to absorb ink that may remain on capped printheads (not shown in FIG. 1) after servicing or that may drool or drain from the nozzles thereof (also not shown in FIG. 1) while the printheads are capped.

Figure 3:
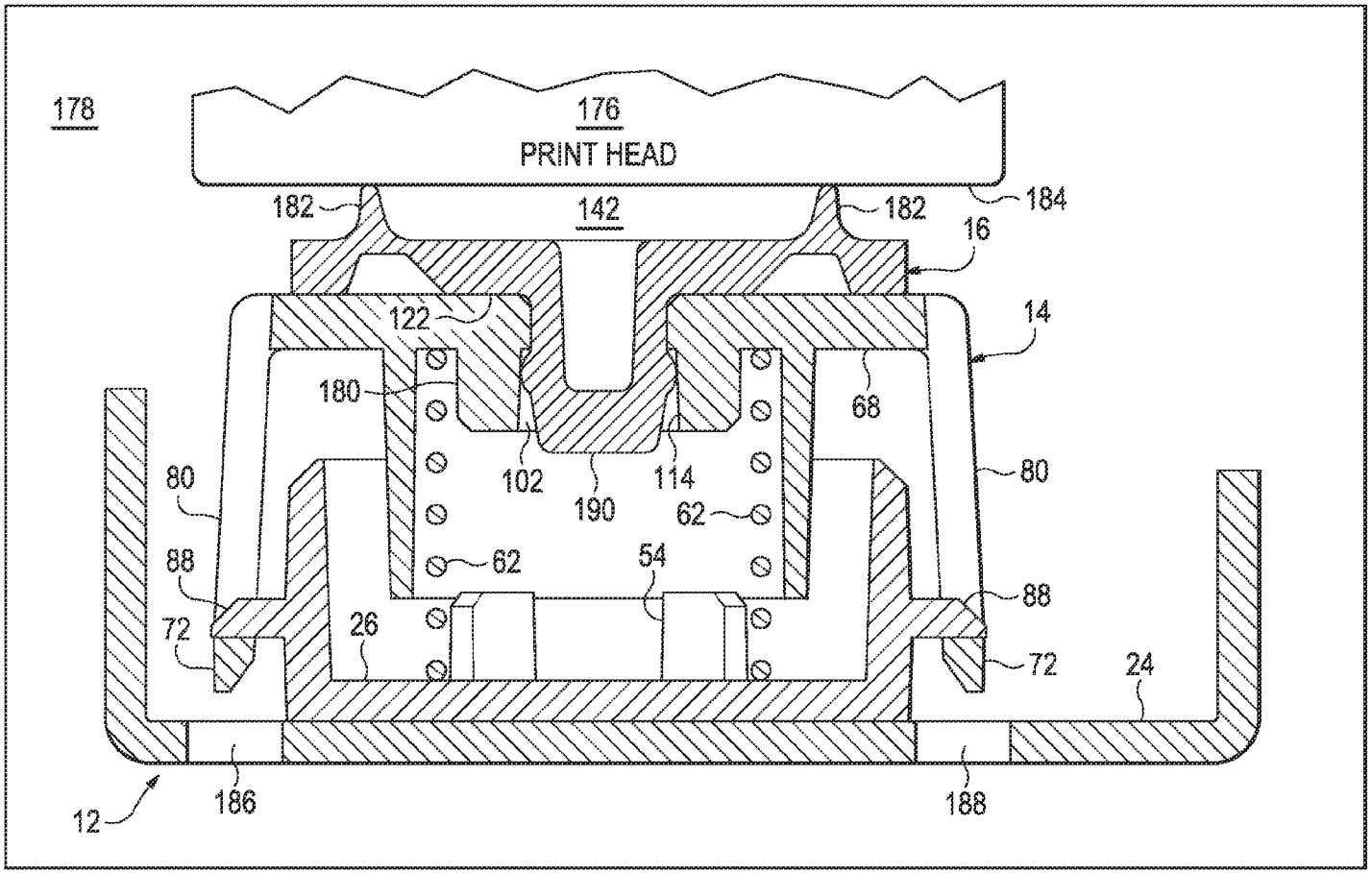
FIG. 3 shows an example of a cross-sectional view of the printhead cap assembly of FIG. 1 taken along line 3-3.

FIG. 3 shows an example of a cross-sectional view of printhead cap assembly 10 taken along line 3-3 of FIG. 1. An outline of an exemplary printhead 176 has been added for illustration. Printhead 176 is part of printing device 178 which has also been added in FIG. 3 for purposes of illustration. As can be seen in FIG. 3 and discussed above, a boss 180 is formed on or attached to bottom side 68 of mount 14 around which biasing member 62 is positioned. Similar bosses (not shown in FIG. 3) exist on bottom side 68 of mount 14 for biasing members 60 and 66.

As can be seen in FIG. 3, sealing member 16 of cap assembly 10 is configured to include a lip 182 that contacts face 184 of printhead 176 to complete the function of sealing the nozzles (not shown) thereof. Lip 182 may be made from an elastomeric material to facilitate such sealing and also to provide a certain amount of deflection or give upon contact with face 184 of printhead 176. Further deflection is provided by biasing member 62 which is compressible. Openings 186 and 188 in stiffener 24 provide clearance for side members 72 during any such further deflection. Although not shown in FIG. 3, it is to be understood that similar openings in stiffener 24 may be provided for side members 70, 74, and 76 (shown in FIG. 2).

Figure 4:
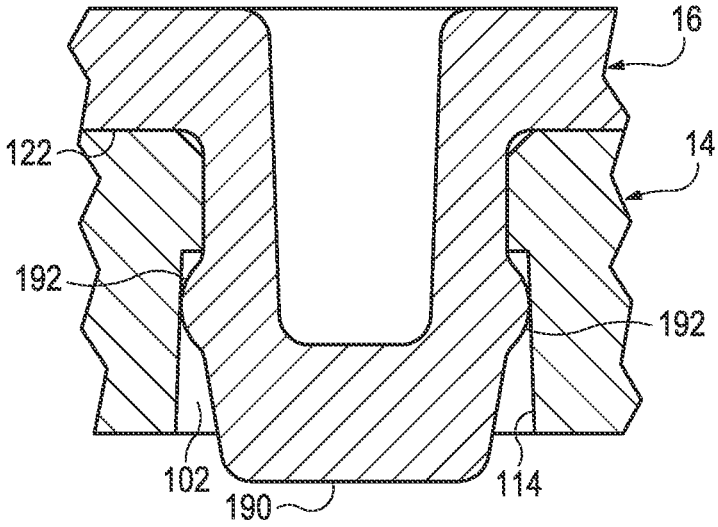
FIG. 4 shows an enlarged view of an example of a mounting flange or retention feature.

As can further be seen in FIG. 3, sealing member 16 is configured to include a mounting flange or retention feature 190 located on bottom 122 at position 128 (see FIG. 2). An enlarged view of mounting flange or retention feature 190 is shown in FIG. 4. As can be seen in FIG. 4, mounting flange or retention feature 190 is disposed or otherwise positioned in opening 102 of mount 14 to orient or align and couple or attach seating member 16 to mount 14. Mounting flange or retention feature 190 includes a dart 192 which is designed to engage and grip wall 114 of mount 14 thereby attaching and accurately aligning sealing member 16 to mount 14. Although not shown in FIGS. 3 and 4, it is to be understood that cap assembly 10 includes additional mounting flanges or retention features (like mounting flange or retention feature 190) located at generally indicated positions 124, 126, 130, 132, and 134 (see FIG. 2).

Figure 5:
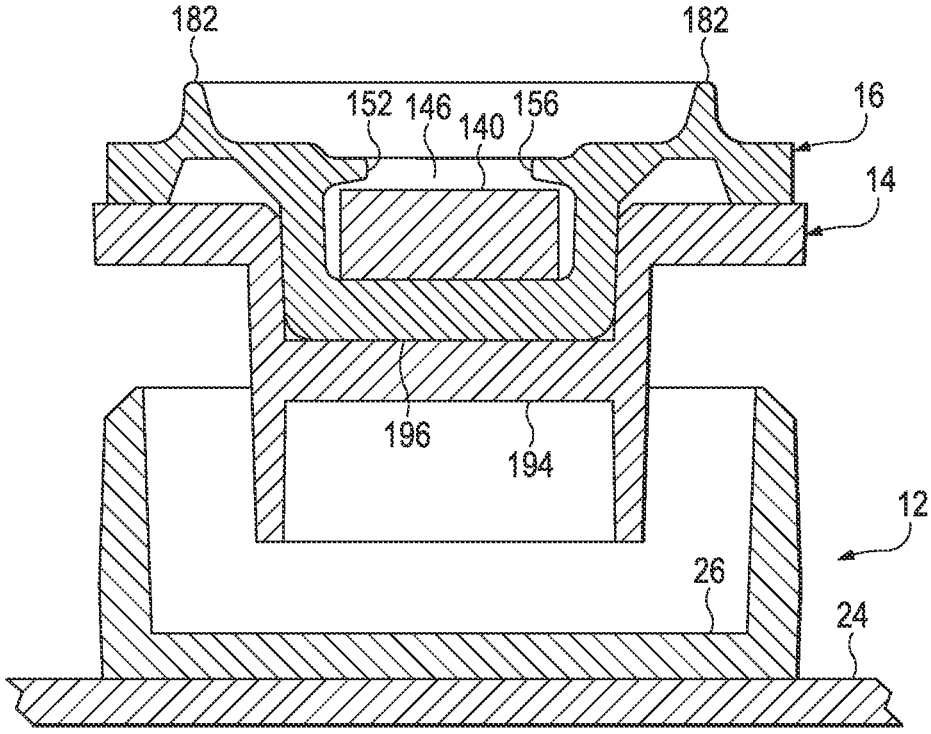
FIG. 5 shows an example of a cross-sectional view of the printhead cap assembly of FIG. 1 taken along line 5-5.

A cross-sectional view of printhead cap assembly 10 taken along line 5-5 of FIG. 1 is shown in FIG. 5. FIG. 5 provides a different perspective of cap assembly 10 than that shown in FIG. 3. For example, tabs 152 and 156 are shown which are used to hold pad 140 within well 146. As another example, portion 194 is shown rather than an opening, recess, or cavity for a retention feature or mounting flange. Portion 194 provides support for bottom 196 of seat member 16.

Figure 6:
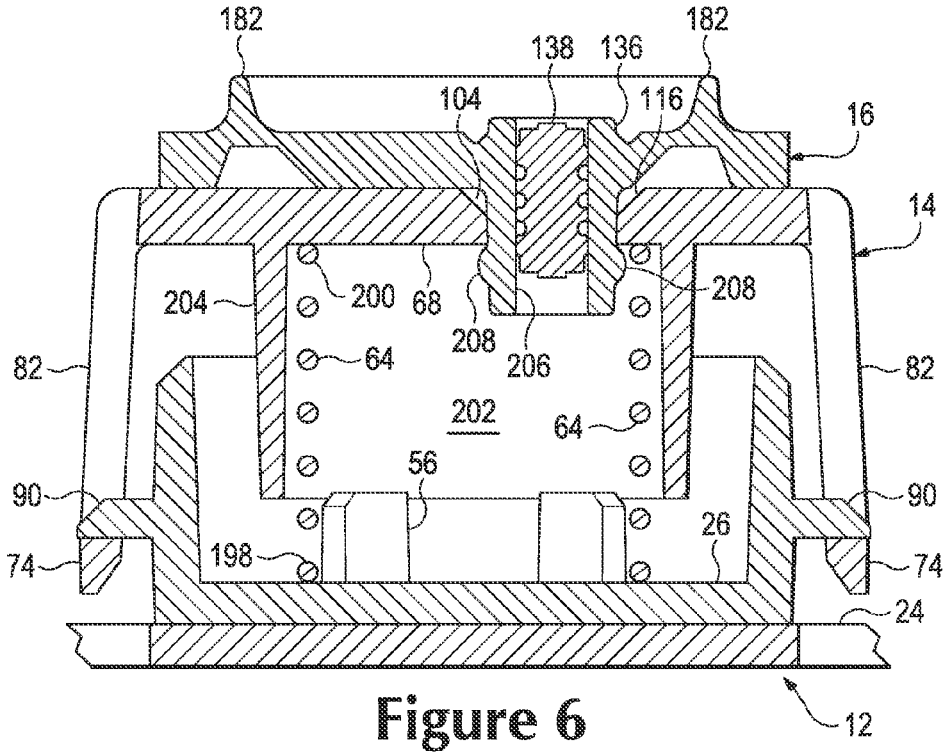
FIG. 6 shows an example of a cross-sectional view of the printhead cap assembly of FIG. 1 taken along line 6-6.

A cross-sectional view of printhead cap assembly 10 taken along line 6-6 of FIG. 1 is shown in FIG. 6. As can be seen in FIG. 6, one end 198 of biasing member 64 is disposed on boss 56 and the other end 200 of biasing member 64 is positioned adjacent bottom side 68 of mount 14 within the cavity 202 defined by downwardly depending, generally cylindrical member 204. Member 204 helps maintain lateral stability of biasing member 64.

As can also be seen in FIG. 6 and as discussed above, ambient vent 136 is formed in sealing member 16. Vent plug 138 is disposed or positioned in cavity, recess, or opening 206 defined by ambient vent 136. Ambient vent 136 and vent plug 138 allow for gaseous communication with the ambient environment. As can further be seen in FIG. 6, ambient vent 136 is configured to include a retention feature or flange 208 that engages bottom side 68 of mount 14 to help secure sealing member 16 to mount 14. Retention feature or flange 208 includes a dart in the example shown in FIG. 6.

Figure 7:
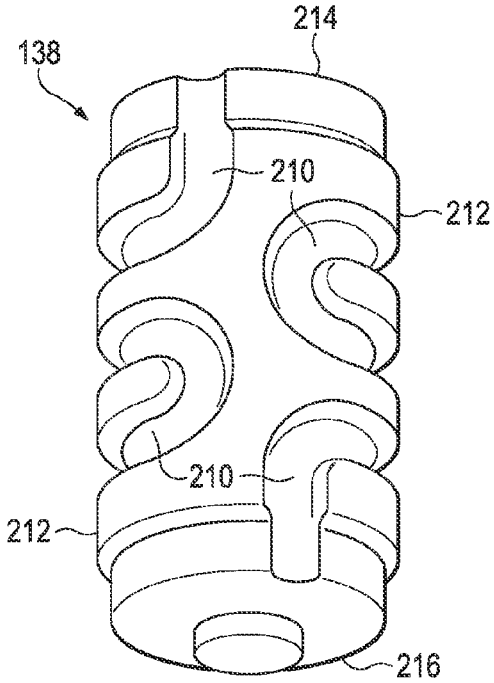
FIG. 7 shows an example of a vent plug.

FIG. 7 shows an enlarged view of vent plug 138. As can be seen in FIG. 7, vent plug 138 is configured to include a labyrinth channel 210. Labyrinth channel 210 extends around circumference 212 of vent plug 138 in a spiraling or serpentine manner from end 214 to end 216, as shown. Vent plug 138 helps prevent water vapor transmission from capped printheads to the ambient environment while labyrinth channel 210 allows a sufficient quantity of ambient air to flow to help compensate for barometric fluctuations, pressure changes due to temperature excursions, and pressure changes due to altitude excursions that may occur during transportation and general use.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, although a single ambient vent 136 and vent plug 138 have been shown, other exemplary embodiments of the cap assembly of the present invention may include two or more such ambient vents and plugs. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A printhead cap assembly for use in a printing device, comprising:

a rigid base member;

a mount gimbaled with respect to the rigid base member and configured to define an opening through the mount, the opening including a wall; and a sealing member including a retention feature having a protrusion around a circumference of the retention feature, the retention feature being integral to a bottom surface of the sealing member adjacent to a top surface of the mount to orient and couple the sealing member to the mount so that the sealing member retains an original shape, the retention feature to extend through the opening and the protrusion to engage and grip the wall of the opening.

2. The printhead cap assembly of claim 1, further comprising an ambient vent formed in the sealing member and configured to communicate with an ambient environment.

3. The printhead cap assembly of claim 2, further comprising a vent plug disposed in the ambient vent and configured to include a labyrinth channel.

4. The printhead cap assembly of claim 2, wherein the retention feature further has a through hole through a length of the retention feature from a top surface of the sealing member to an end of the retention feature adjacent to a bottom surface of the mount, the ambient vent to include the through hole.

5. The printhead cap assembly of claim 1, in a printing device.

6. The printhead cap assembly of claim 1, wherein the sealing member is configured to include an elastomeric lip.

7. The printhead cap assembly of claim 1, wherein the sealing member further includes another retention feature integral with the bottom surface of the sealing member to further orient and couple the sealing member to the mount, the other retention feature including a through hole from a top surface of the sealing member to a retention feature end adjacent to a bottom surface of the mount, the other through hole to provide an ambient vent in the sealing member.

8. The printhead cap assembly of claim 1, wherein the protrusion is rounded and without sharp edges.

9. A printhead cap assembly for use in a printing device, comprising:

a stiffener having openings;

a plate disposed on the stiffener, wherein fasteners disposed through the openings are to separably couple the stiffener to the plate;

a mount coupled to the plate and configured to define an opening through the mount, the opening including a wall;

a gimbal assembly positioned between the plate and the mount; and a sealing member configured to include a mounting flange disposed in the opening to align and attach the sealing member to the mount without distorting the sealing member, the mounting flange having a protrusion to engage and grip the wall of the opening.

10. The printhead cap assembly of claim 9, further comprising an ambient vent formed in the sealing member and configured to communicate with an ambient environment.

11. The printhead cap assembly of claim 10, further comprising a vent plug disposed in the ambient vent and configured to include a labyrinth channel.

12. The printhead cap assembly of claim 10, wherein the mounting flange further includes a through hole through a length of the mounting flange from a top surface of the sealing member to a bottom surface of the mount, the ambient vent to include the though hole.

13. The printhead cap assembly of claim 9, in a printing device.

14. The printhead cap assembly of claim 9, wherein the sealing member is configured to include an elastomeric lip.

15. The printhead cap assembly of claim 9, wherein the gimbal assembly includes a biasing member compressibly positioned between the plate and the mount.

16. The printhead cap assembly of claim 9, wherein the mounting flange has a cylindrical shape and the protrusion extends around a circumference of the mounting flange.

17. The printhead cap assembly of claim 9, wherein the protrusion is rounded and without sharp edges.

18. A printhead cap assembly for use in a printing device, comprising:

a rigid support;

a gimbaled mount disposed on the rigid support and configured to include a first opening through the gimbaled mount and a second opening through the gimbaled mount; and a sealing member including a first mounting flange to extend into the first opening, and including a second mounting flange to extend through the second opening, the second mounting flange having a through hole through a length thereof, the first and second mounting flanges being configured to position and fix the sealing member to the gimbaled mount, wherein the through hole is an ambient vent in the sealing member.

19. The printhead cap assembly of claim 18, further comprising a vent plug positioned in the ambient vent and configured to include a labyrinth channel.

20. The printhead cap assembly of claim 18, wherein the sealing member is configured to include an elastomeric lip.

21. The printhead cap assembly of claim 18, wherein the gimbaled mount includes a biasing member.

22. The printhead cap assembly of claim 18, wherein one or both of the first mounting flange and the second mounting flange includes a protrusion around a circumference of the respective mounting flange to engage and grip the respective opening.

* * * * *